US009216418B2

(12) United States Patent
Schaefer et al.

(10) Patent No.: US 9,216,418 B2
(45) Date of Patent: Dec. 22, 2015

(54) HYDRAULIC MILLING BALL FEED AND DISCHARGE FOR STIRRED BALL MILLS

(71) Applicant: NETZSCH-Feinmahitechnik GmbH, Selb (DE)

(72) Inventors: Matthias Schaefer, Neustadt b. Coburg (DE); Michael Lechner, Grossheirath (DE); Uwe Neumann, Wiesbaden (DE); Dimitrios Makrakis, Hof (DE); Udo Enderle, Marktrewitz (DE); Gerhard Kolb, Rehau (DE); Stefan Mende, Selb (DE); Klaus Ott, Sparneck (DE); Horst Pausch, Schwarzenbach/Saale (DE); Michael Rappl, Pechbrunn (DE); Peter Schertenleib, Selb (DE); Michael Schmidt, Selb (DE); Peter Stich, Tirschenreuth (DE); Lars Weiland, Schoenwald (DE)

(73) Assignee: NETZSCH-Feinmahltechnik GmbH, Selb (DE)

( * ) Notice: Subject to any disclaimer, the term of this patent is extended or adjusted under 35 U.S.C. 154(b) by 109 days.

(21) Appl. No.: 13/902,396

(22) Filed: May 24, 2013

(65) Prior Publication Data

US 2013/0256434 A1 Oct. 3, 2013

Related U.S. Application Data

(63) Continuation of application No. PCT/DE2011/002024, filed on Nov. 22, 2011.

(30) Foreign Application Priority Data

Nov. 26, 2010 (DE) ..... 10 2010 052 656

(51) Int. Cl.
*B02C 17/20* (2006.01)
*B02C 17/16* (2006.01)

(52) U.S. Cl.
CPC ..... *B02C 17/205* (2013.01); *B02C 17/161* (2013.01)

(58) Field of Classification Search
CPC ..... B02C 17/18; B02C 17/16; B02C 17/20; B02C 17/205
USPC ..... 241/21, 30, 171, 172, 184
See application file for complete search history.

(56) References Cited

U.S. PATENT DOCUMENTS

| | | | | |
|---|---|---|---|---|
| 5,624,080 | A | 4/1997 | Stehr et al. | |
| 5,718,388 | A * | 2/1998 | Czekai et al. | 241/21 |
| 2001/0016467 | A1 * | 8/2001 | Weichert | 451/32 |

FOREIGN PATENT DOCUMENTS

| | | | |
|---|---|---|---|
| DE | 7038335 | U | 11/1972 |
| DE | 3038794 | A1 | 5/1982 |
| DE | 3727863 | C1 | 3/1989 |

(Continued)

OTHER PUBLICATIONS

International Search Report Application No. PCT/DE2011/002024 Completed: Oct. 24, 2012; Mailing Date: Nov. 7, 2012 2 pages.

*Primary Examiner* — Mark Rosenbaum
(74) *Attorney, Agent, or Firm* — Whitmyer IP Group LLC

(57) ABSTRACT

A method for the introduction of auxiliary grinding bodies into an agitator ball mill and for the removal of auxiliary grinding bodies from an agitator ball mill. The auxiliary grinding bodies are transported into the agitator ball mill and out of the latter via a closed circuit by means of a hydraulic conveying medium.

11 Claims, 5 Drawing Sheets

(56) References Cited

FOREIGN PATENT DOCUMENTS

| | | | |
|---|---|---|---|
| DE | 3902689 | C1 | 2/1990 |
| DE | 4432200 | C1 | 2/1996 |
| DE | 10338592 | A1 | 3/2005 |
| EP | 0982074 | A1 | 3/2000 |

* cited by examiner

HYDRAULIC MILLING BALL FEED AND DISCHARGE FOR STIRRED BALL MILLS

FIELD OF THE INVENTION

The present invention relates to a method for the hydraulic grinding ball feed and discharge in agitator ball mills.

BACKGROUND OF THE INVENTION

German patent DE 37 27 863 C1 discloses an agitator mill with a feed pipe for the grinding bodies. The grinding container comprises a rotatably driven agitator and, around the latter, a grinding space that can be filled at least partially with grinding bodies and grinding stock. A feed pipe, through which grinding bodies are fed from the exterior to a central region of the grinding container while the agitator is running, emerges into a hollow space in the agitator. An essentially radial outlet opening in the agitator is connected to the grinding space. A rapid feed of grinding bodies is thus enabled.

German patent specification DE 39 02 689 C1 discloses a device for the introduction of auxiliary grinding bodies into mills, in particular agitator mills. A housing, which is connected to a grinding container, contains a conveying space which can be connected to a grinding space in the grinding container. Auxiliary grinding bodies are fed to the conveying space through an inlet opening in the housing. A conveying element is able to move in the conveying space in order to convey auxiliary grinding bodies from the inlet opening through an elastic closure in the direction of the grinding space. The elastic closure comprises at least one slot, which extends at right angles to the conveying direction of the conveying element and is normally closed, but allows a plurality of auxiliary grinding bodies to pass through beside one another under a pressure exerted by the conveying element.

German patent specification DE 44 32 200 C1 discloses an agitator mill, wherein the latter is provided with a separate grinding stock/auxiliary grinding body separating device. The separating device comprises a rotatably driven rotor for separating the auxiliary grinding bodies from the treated grinding stock. The auxiliary grinding bodies are transported back to the agitator mill with untreated grinding stock. Together with the agitator mill and the lines connecting the latter, the separating device forms a closed system.

The agitator mill disclosed in German patent application DE 103 38 592 A1 comprises a grinding container and a rotatably driven agitator disposed in the latter. A grinding stock feed emerges into the grinding space and a grinding stock discharge emerges out of the grinding space. The grinding space is at least partially filled with auxiliary grinding bodies. The grinding stock discharge is, at one and the same time, an auxiliary grinding body extraction and separating device. It comprises a separator for auxiliary grinding bodies, which has a separating region, into the upper region whereof an extraction line dipping into the grinding stock/auxiliary grinding body mixture emerges. A sluice is integrated in the line for the auxiliary grinding body feedback.

There is known from DE 10 2009 019 501 A1 a device with which grinding bodies can be removed from an agitator ball mill. This device is a multi-part pipe, which is introduced into the grinding chamber through the grinding container floor in the vicinity of the grinding container base. As a result of a flow in the grinding container, the grinding bodies are carried out of the grinding container through openings in the pipe via a line. The pipe is disposed so as to be movable in the agitator ball mill, so that the openings are located in the region of the greatest density of grinding bodies.

Devices and methods are therefore known from the prior art, with which auxiliary grinding bodies can be introduced in the dry state into a mill. Systems are also known which make it possible to remove auxiliary grinding bodies and grinding stock jointly from a mill in order subsequently to separate the latter. A drawback with all these devices, methods and/or systems is that the mill always has to be opened for the complete removal and/or replacement of the auxiliary grinding bodies.

SUMMARY OF THE INVENTION

One problem underlying the invention, therefore, is to create a method with which the auxiliary grinding bodies can be filled into an agitator ball mill and/or be removed from an agitator ball mill in a time-saving manner and without high expenditure on equipment and personnel.

The problem is solved by a method comprising the features of the present teachings. Further advantageous embodiments can also be seen from the features of the present teachings.

The present invention discloses a method for the introduction of auxiliary grinding bodies into an agitator ball mill and for the removal of auxiliary grinding bodies from an agitator ball mill. According to the invention, the auxiliary grinding bodies are transported into and out of the agitator ball mill via a closed circuit by means of a hydraulic conveying medium. The circuit is also to be regarded as closed when a closed or an open storage container is used to carry out the method. It must however be ensured that the conveying medium can always be circulated in the circuit without the introduction of air and/or other gases. The auxiliary grinding bodies are conveyed into the grinding container via the grinding stock inlet and are also conveyed out again from the grinding stock inlet.

During the filling, the auxiliary grinding bodies are held ready in a storage container, together with the hydraulic conveying medium. A pump sucks the hydraulic conveying medium via a first line and a second line through a grinding container of the agitator ball mill. The auxiliary grinding bodies are sucked into the grinding container or pressed into the grinding container together with the hydraulic conveying medium. Depending on how the pump and the lines are connected to the grinding container and the storage container, the conveying flow for the auxiliary grinding bodies is produced either by suction or pressure. The conveying medium is pumped out of the grinding container at a somewhat higher point and/or through a separating device, the auxiliary grinding bodies remaining in the grinding container.

For the purpose of emptying, the hydraulic conveying medium is pumped by the pump out of the storage container via the second line into the grinding container. The auxiliary grinding bodies are pumped or pressed, together with the hydraulic conveying medium, via the first line out of the grinding container into the storage container. After reaching the storage container, the auxiliary grinding bodies remain in the latter. The hydraulic conveying medium, on the other hand, is circulated in the circuit until such time as all the auxiliary grinding bodies have been removed from the grinding container.

When the auxiliary grinding bodies are removed from the agitator ball mill, the agitator shaft is temporarily set in a rotary motion. As a result of the rotary motion of the agitator shaft, there arises in the grinding container an additional flow which swirls up the auxiliary grinding bodies and causes the latter to be suspended in the conveying medium. The removal of the auxiliary grinding bodies by the flowing conveying medium is thus markedly improved.

The hydraulic conveying medium is always removed from a calm zone of the storage container. The removal from the calm zone is important, because no auxiliary grinding bodies must be allowed to get into the pump and no air and/or gases into the grinding container. The calm zone is characterised in that no auxiliary grinding bodies are present in it. Furthermore, no flow or only a small flow is present in the calm zone. In most cases, the calm zone is a region which is separated from the storage container by a wall. The conveying medium then passes either via perforations or openings in the wall into the calm zone.

During the filling and/or the emptying procedure, the hydraulic conveying medium is pumped into the grinding container in the middle of a grinding container floor. In a further embodiment, the hydraulic conveying medium is pumped in via the grinding container floor beneath the agitator shaft during the filling procedure and/or during the emptying. As a result of the introduction of the conveying medium beneath the agitator shaft, it is flushed directly into a bed of auxiliary grinding bodies which is present at the bottom of the grinding container. Additional turbulence of the auxiliary grinding bodies is thus produced. This turbulence is very helpful during the removal of the auxiliary grinding bodies.

During the filling procedure and/or during the emptying, the grinding container of the agitator ball mill is filled at least up to 90%, preferably up to 95%, with hydraulic conveying medium and/or auxiliary grinding bodies. The less air and/or other gases present in the grinding container, the better the flow for providing the auxiliary grinding body transport can be regulated. Water or another suitable liquid medium can be used as a conveying medium.

BRIEF DESCRIPTION OF THE DRAWINGS

Examples of embodiments of the invention and their advantages are explained in detail below with the aid of the appended figures.

DETAILED DESCRIPTION OF THE INVENTION

Figure 1:
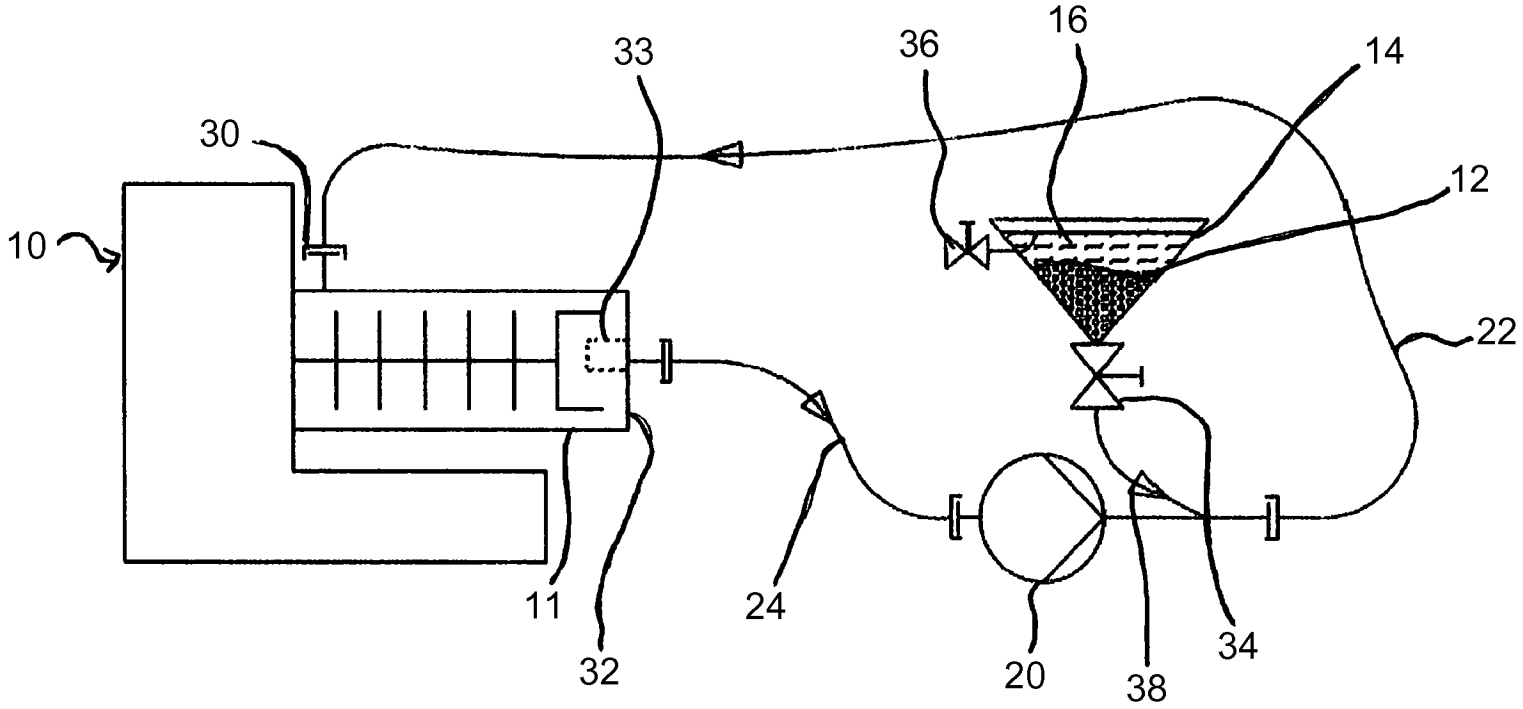
FIG. 1 shows the filling of auxiliary grinding bodies into an agitator ball mill with a special storage container.

FIG. 1 shows the filling of auxiliary grinding bodies 12 into an agitator ball mill 10 with a special storage container 14. In this example embodiment, storage container 14 has a shape tapering conically downwards and is provided with a first shut-off element 34 and a second shut-off element 36. Auxiliary grinding bodies 12 are held ready in storage container 14 together with hydraulic conveying medium 16. A first shut-off element 34 is opened in order to remove the mixture comprising auxiliary grinding bodies 12 and conveying medium 16. Pump 20 then conveys the mixture via a first line 22 to grinding stock inlet 30 of grinding container 11. In the example of the embodiment described, the feeding of the mixture to the grinding container takes place through a connection line 38, wherein the flowing mixture in first line 22 generates a suction effect, similar to a water jet pump. The pump sucks conveying medium 16 out of agitator ball mill 10 via a second line 24 and presses it back into grinding container 11 via a first line 22. A circulation thus arises in a closed circuit. Furthermore, during this filling procedure, conveying medium 16 is sucked out of grinding container 11 by means of the separating element.

Figure 2:
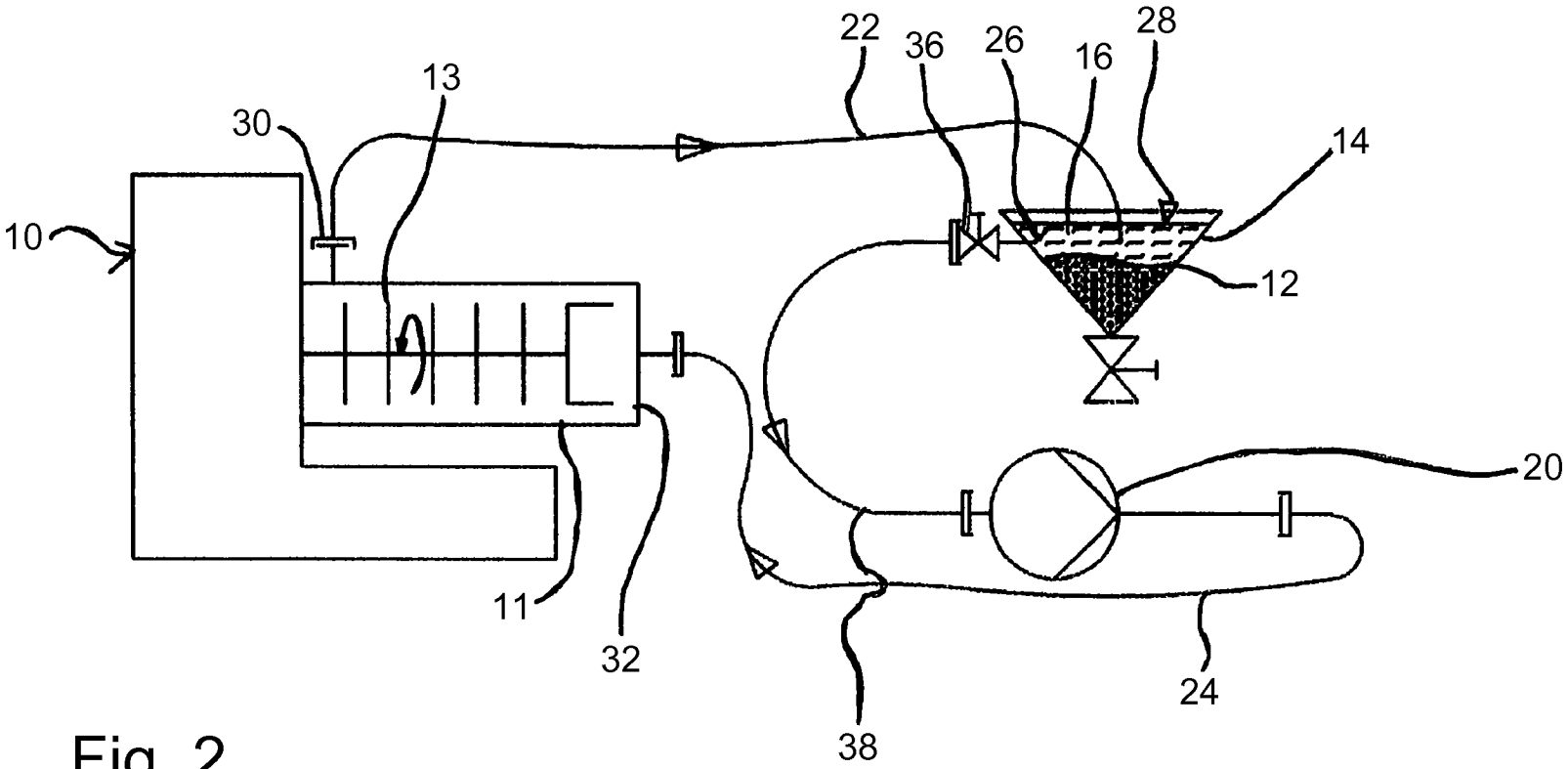
FIG. 2 shows the removal of auxiliary grinding bodies from an agitator ball mill with a special storage container.

FIG. 2 shows the removal of auxiliary grinding bodies 12 from an agitator ball mill 10 with a special storage container 14. When hydraulic conveying medium 16 is being removed from storage container 14, it must be ensured that removal point 26 for conveying medium 16 always lies below conveying medium level 28 in order not to suck in any air. For this purpose, removal point 26 should be positioned by the user and/or by a stand beneath the level of the conveying medium. If removal point 26 is correctly positioned, second shut-off element 36 is opened and conveying medium 16 passes via connection line 38 to pump 20. Pump 20 conveys conveying medium 16 through second line 24 into grinding container 11. The pumping-in takes place via the point in grinding container floor 32 through which conveying medium 16 was removed in FIG. 1. By means of conveying medium 16 pumped through grinding container 11, a flow arises by means of which auxiliary grinding bodies 12 are carried out via grinding stock inlet 30 of grinding container 11. Auxiliary grinding bodies 12, together with conveying medium 16, pass into storage container 14 via first line 22. In order to be able to remove completely all auxiliary grinding bodies 12 from grinding container 11, it is necessary for agitator shaft 13 to be set in rotation temporarily. An additional flow thus arises, by means of which auxiliary grinding bodies 12 are swirled up in grinding container 11 and flushed out of the latter.

Figure 3:
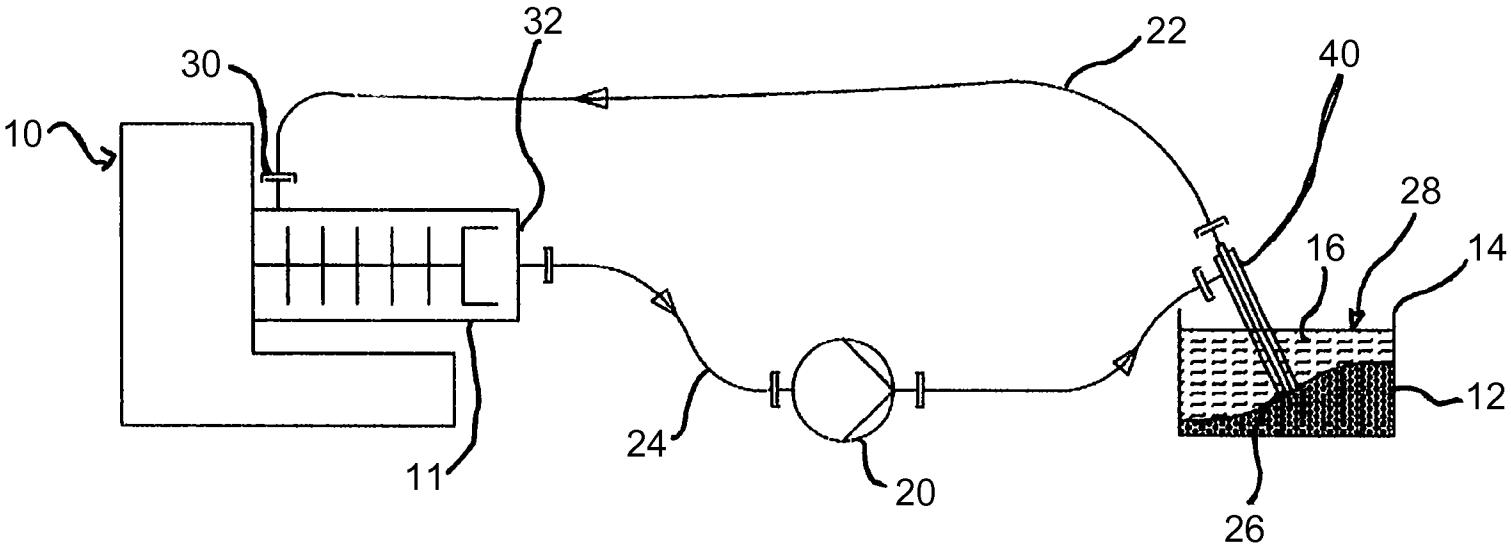
FIG. 3 shows the filling of auxiliary grinding bodies into an agitator ball mill with a simple storage container.

FIG. 3 shows the filling of auxiliary grinding bodies 12 into an agitator ball mill 10 with a simple storage container 14. In contrast with storage container 14 described in FIGS. 1 and 2, this one does not comprise any shut-off elements, does not have a special shape and does not comprise any fixedly mounted outlets. On the contrary, this example of embodiment is intended to make clear that the procedure for filling and emptying can also be carried out with containers commonly available commercially. Grinding bodies 12 and hydraulic conveying medium 16 are held ready in storage container 14. Pump 20 generates a material flow, by means of which conveying medium 16 passes into a removal device 40. A diversion of the material flow into first line 22 takes place in removal device 40. An underpressure thus arises, with which auxiliary grinding bodies 12 are sucked out of storage container 14. During this procedure, it must be ensured that removal point 26 always lies below conveying medium level 28 of storage container 14, so that neither air nor other gases can get into the material flow. The mixture then passes via grinding stock inlet 30 into grinding container 11. Auxiliary grinding bodies 12 remain in the grinding container, conveying medium 16 being sucked via an opening or through a separating device (not represented) in grinding container floor 32 and circulated in the circuit.

Figure 4:
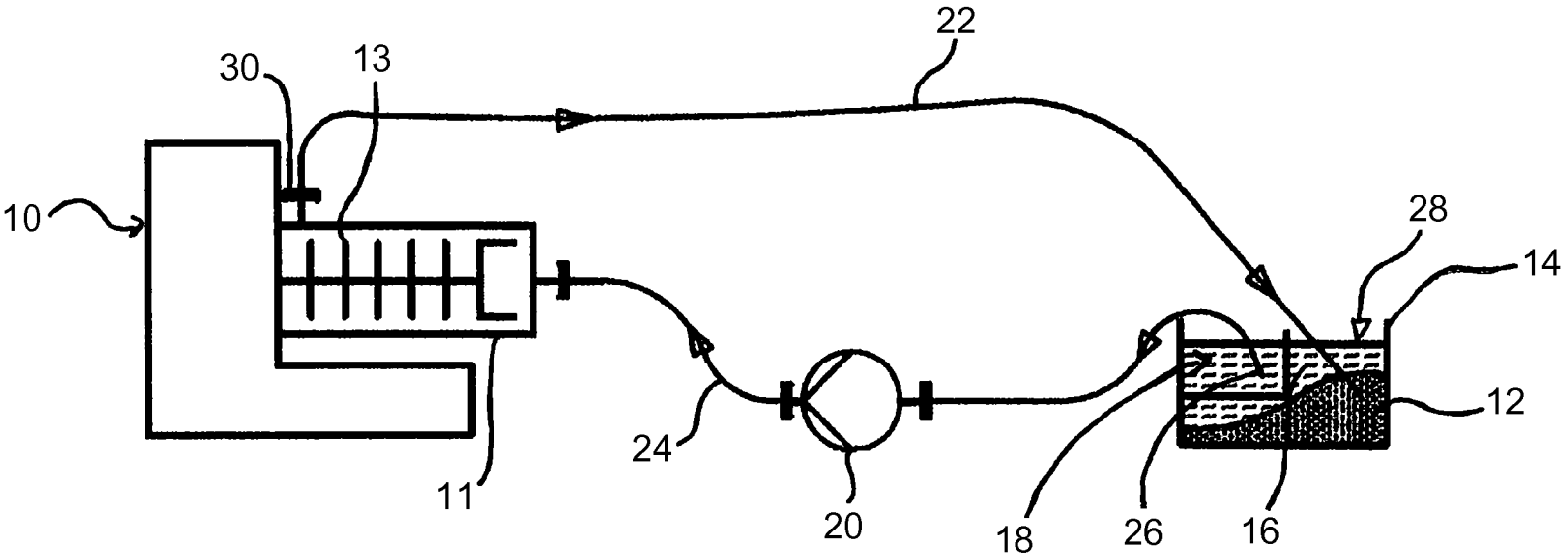
FIG. 4 shows the removal of auxiliary grinding bodies from an agitator ball mill with a simple storage container.

FIG. 4 shows the removal of auxiliary grinding bodies 12 out of an agitator ball mill 10 with a simple storage container 14. In this example embodiment, hydraulic conveying medium 16 is pumped by pump 20 out of a calm zone 18 of storage container 14 and flushed via second line 24 into grinding container 11. Calm zone 18 is characterised in that only a small flow and no auxiliary grinding bodies 12 are present in it. In calm zone 18, removal point 26 for conveying medium 16 is always disposed below conveying medium level 28. By means of inflowing conveying medium 16, auxiliary grinding bodies 12 are flushed out of grinding container 11 via grinding stock inlet 30. Auxiliary grinding bodies 12 pass, together with conveying medium 16, via first line 22 into storage container 14. In order to be able to remove completely all auxiliary grinding bodies 12 from grinding container 11, it is necessary for agitator shaft 13 to be set in rotation temporarily. An additional flow thus arises, by means of which auxiliary grinding bodies 12 are swirled up in grinding container 11 and flushed out of the latter.

Figure 5:
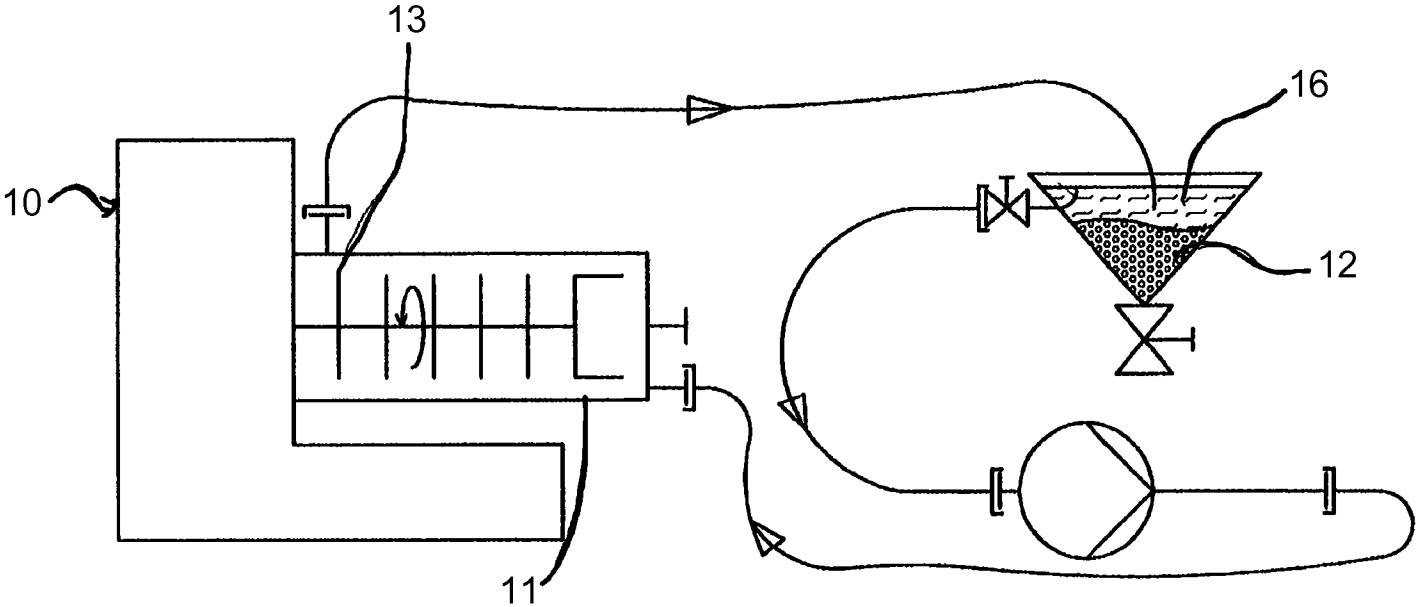
FIG. 5 shows the removal of auxiliary grinding bodies from an agitator ball mill, wherein the hydraulic conveying medium is pumped in beneath the agitator shaft.

FIG. 5 shows the removal of auxiliary grinding bodies 12 from an agitator ball mill 10, wherein hydraulic conveying medium 16 passes into grinding container 11 beneath agitator shaft 13. The example embodiment represented in FIG. 5 functions in principle in the same way as that described in FIG. 2. The only, and most important, difference lies in the feed-in of conveying medium 16 beneath agitator shaft 13. As a result of this type of feed-in, more intense turbulence and a more turbulent flow arise in grinding container 11 than in the case of the example embodiment described in FIG. 2. In order to be able to remove completely all auxiliary grinding bodies 12 from grinding container 11, it is also necessary here for agitator shaft 13 to be set in rotation temporarily.

In a further embodiment (not represented) for the filling of agitator ball mill 10, conveying medium 16 together with auxiliary grinding bodies 12 is pumped in beneath agitator shaft 13 via a connecting piece close to the grinding container base. Conveying medium 16 exits via an opening, this opening being disposed upstream of a separating device. Auxiliary grinding bodies 12 remain in grinding container 11.

The invention has been described by reference to a preferred embodiment.

What is claimed is:

1. A method for the introduction of auxiliary grinding bodies into an agitator ball mill and for the removal of auxiliary grinding bodies from an agitator ball mill, the method comprising transporting the auxiliary grinding bodies into the agitator ball mill and out of the agitator ball mill via a closed circuit by means of a hydraulic conveying medium, the auxiliary grinding bodies being conveyed into and out of the grinding container via a grinding stock inlet.

2. The method of claim 1, wherein the agitator shaft is temporarily rotated during the removal of the auxiliary grinding bodies from the agitator ball mill.

3. The method of claim 1, wherein the hydraulic conveying medium is always removed from a calm zone of a storage container.

4. The method of claim 3, wherein the calm zone is always kept free from auxiliary grinding bodies.

5. The method of claim 1, wherein, during the filling procedure and/or during the emptying procedure, the grinding container of the agitator ball mill is filled at least up to 90% with hydraulic conveying medium and/or auxiliary grinding bodies.

6. The method of claim 1, wherein water or another suitable liquid medium is used as the conveying medium.

7. The method of claim 1, wherein the conveying medium exits from the grinding container through a separating device.

8. A method for the introduction of auxiliary grinding bodies into an agitator ball mill and for the removal of auxiliary grinding bodies from an agitator ball mill, the method comprising transporting the auxiliary grinding bodies into the agitator ball mill and out of the agitator ball mill via a closed circuit by means of a hydraulic conveying medium, the auxiliary grinding bodies being conveyed into and out of the grinding container via a grinding stock inlet, wherein the auxiliary grinding bodies are held ready in a storage container together with the hydraulic conveying medium, wherein the hydraulic conveying medium is sucked/pressed by means of a pump via a first line and a second line through a grinding container of the agitator ball mill, and wherein the auxiliary grinding bodies together with the hydraulic conveying medium are sucked/pressed into the grinding container, the auxiliary grinding bodies remaining in the grinding container.

9. A method for the introduction of auxiliary grinding bodies into an agitator ball mill and for the removal of auxiliary grinding bodies from an agitator ball mill, the method comprising transporting the auxiliary grinding bodies into the agitator ball mill and out of the agitator ball mill via a closed circuit by means of a hydraulic conveying medium, the auxiliary grinding bodies being conveyed into and out of the grinding container via a grinding stock inlet, wherein the hydraulic conveying medium is pumped by the pump out of the storage container via a second line into the grinding container, wherein the auxiliary grinding bodies with the hydraulic conveying medium are pumped via a first line out of the grinding container into the storage container, wherein the auxiliary grinding bodies remain in the storage container, and wherein the hydraulic conveying medium is circulated in the circuit until such time as all the grinding bodies have been removed from the grinding container.

10. A method for the introduction of auxiliary grinding bodies into an agitator ball mill and for the removal of auxiliary grinding bodies from an agitator ball mill, the method comprising transporting the auxiliary grinding bodies into the agitator ball mill and out of the agitator ball mill via a closed circuit by means of a hydraulic conveying medium, wherein the hydraulic conveying medium is pumped in the middle of a grinding container floor during the filling procedure and/or during the emptying procedure.

11. The method of claim 10, wherein the hydraulic conveying medium is pumped in via the grinding container floor beneath the agitator shaft during the filling procedure and/or during the emptying procedure.

* * * * *